US006389756B1

(12) United States Patent
Oberdorfer

(10) Patent No.: US 6,389,756 B1
(45) Date of Patent: May 21, 2002

(54) COVERING ROSETTE FOR THE CONNECTION REGION OF A SANITARY WALL-FITTING

(75) Inventor: Hans Oberdorfer, Stuttgart (DE)

(73) Assignee: Hansa Metallwerke AG (DE)

( * ) Notice: Subject to any disclaimer, the term of this patent is extended or adjusted under 35 U.S.C. 154(b) by 0 days.

(21) Appl. No.: 09/447,902

(22) Filed: Nov. 23, 1999

(30) Foreign Application Priority Data

Nov. 23, 1998 (DE) ..... 198 53 974

(51) Int. Cl.[7] ..... F16L 5/00

(52) U.S. Cl. ..... 52/34; 52/35; 285/46; 285/921; 137/359

(58) Field of Search ..... 52/34, 35, 220.8, 52/212, 301, 720.2; 285/46, 921; 137/359

(56) References Cited

U.S. PATENT DOCUMENTS 1,080,520 A * 12/1913 Schuermann ..... 285/46
1,163,457 A * 12/1915 Regar ..... 285/46
1,278,895 A * 9/1918 Farley ..... 285/46 X
1,592,716 A * 7/1926 Blowers ..... 285/46
2,202,049 A * 5/1940 Fitzgerald ..... 285/46 X
3,964,549 A * 6/1976 McGill ..... 285/46 X
4,366,866 A * 1/1983 Sweeney ..... 285/46 X
4,407,023 A * 10/1983 Norton ..... 285/46 X
4,490,954 A * 1/1985 Cresti ..... 285/46 X
4,678,207 A * 7/1987 Dornbracht et al. ..... 285/46 X
4,770,251 A * 9/1988 Sweet ..... 285/46 X
4,989,278 A * 2/1991 Kostorz ..... 285/46 X
5,291,622 A * 3/1994 Humpert ..... 285/46 X
5,497,584 A * 3/1996 Bergmann ..... 52/34

* cited by examiner

*Primary Examiner*—Beth A. Stephan
*Assistant Examiner*—Brian E. Glessner

(57) ABSTRACT

A covering rosette (8) for the connection region of a sanitary wall-fitting (1) comprises an ornamental hood (8) which is capable of being attached to the mounting-wall, through the central passage opening (10) of which ornamental hood a sleeve (9) extends. The axial position of this sleeve (9) in relation to the ornamental hood (8) can be changed by the sleeve (9) being capable of being screw-coupled on the end of an S-shaped connecting piece (4) facing towards the fitting (1). The ornamental hood (8) is assembled from two halves **(8*a*, 8*b*) which are only subsequently placed from the side around the S-shaped connecting piece (4) and the sleeve (9) when mounting of the wall-fitting (1) on the S-shaped connecting piece (4)** has been concluded.

6 Claims, 3 Drawing Sheets

COVERING ROSETTE FOR THE CONNECTION REGION OF A SANITARY WALL-FITTING

Figure 1:
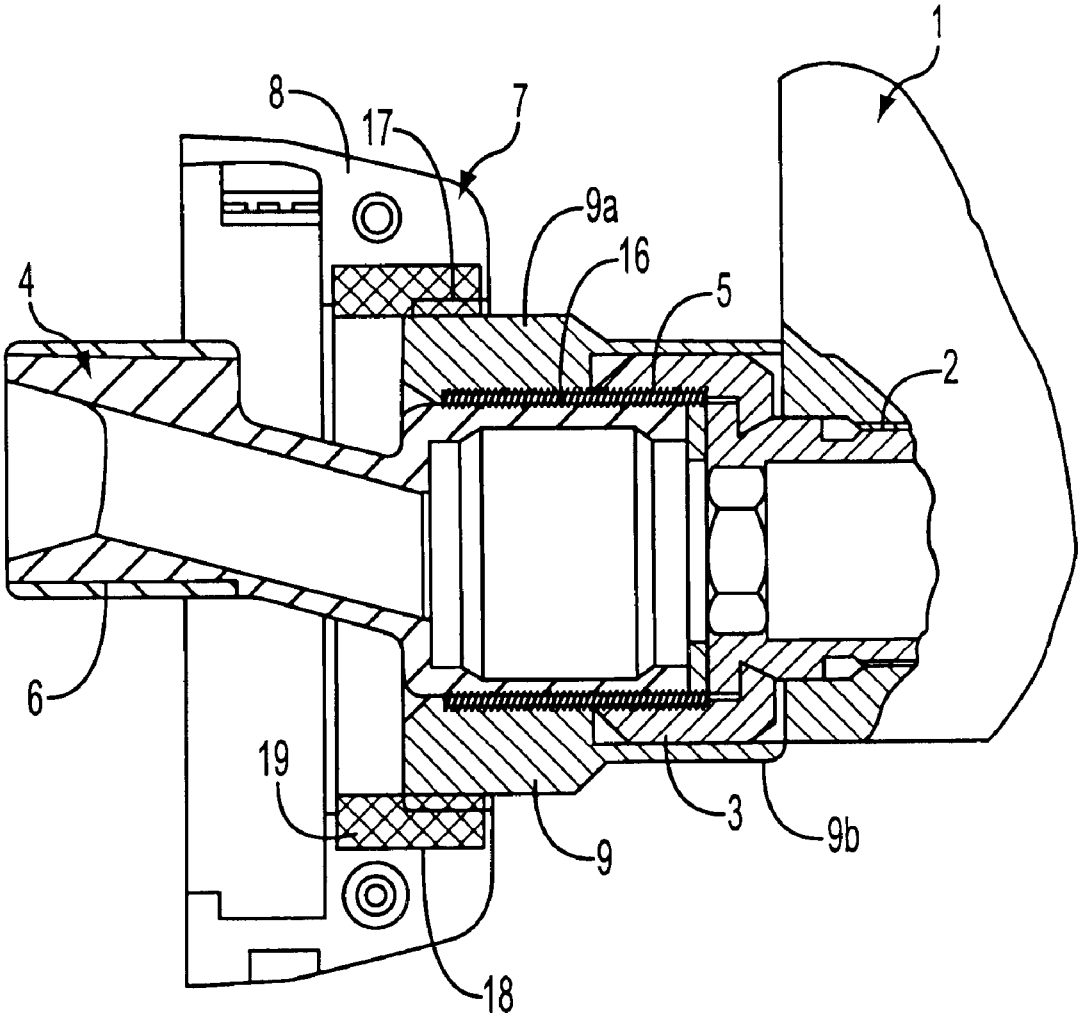

The invention relates to a covering rosette for the connection region of a sanitary wall-fitting with a) an ornamental hood which is capable of being attached to the mounting-wall and which exhibits a central passage opening;

b) a sleeve which is capable of being adjusted in the axial direction in relation to the ornamental hood and which passes through the passage opening of the ornamental hood;

whereby c) the interior spaces of ornamental hood and sleeve are constructed to receive an S-shaped connecting piece which serves for connection between a water service-pipe installed in the mounting-wall and the wall-fitting and also serves to receive a union nut which serves for fastening the wall-fitting to the S-shaped connecting piece.

In the case of sanitary wall-fittings the points of connection to the water service-pipe, which ordinarily comprise an S-shaped connecting piece connecting the connecting socket of the wall-fitting to the service-pipe system, are, as is generally known, visually masked by a covering rosette. On the one hand, this covering rosette has to be capable of being moved in such a way that in one position access is possible to, in particular, the union nut which is fixed to the wall-fitting and which serves for fastening to the S-shaped connecting piece; on the other hand, in its definitive position it has to conceal all the functional parts from the view of the observer, whereby differences in the installed positions of the S-shaped connecting piece and of the wall-fitting have to be capable of being compensated.

In both EP 0 499 886 B1 and in DE 38 06 492 A1 covering rosettes are described wherein a close-fitting gasket which is screwed onto a thread on the fitting side is arranged in the region of the passage opening of the ornamental hood.

For geometric reasons the height of such ornamental hoods cannot be arbitrary; under unfavourable installation conditions it is therefore not always possible to avoid a part of the S-shaped connecting piece, or of the thread on the fitting side, remaining visible.

This problem occurs less frequently in the case of covering rosettes of the type mentioned in the introduction, such as are described in EP 0 537 652 B1, for example. Here the possibility of compensating variable mounting distances of the sanitary wall-fitting from the wall is increased by use being made not only of an ornamental hood for covering the functional parts in the connection region of the wall-fitting but, in addition, of a sleeve which is concentric with this ornamental hood, the axial position of which sleeve in relation to the ornamental hood is capable of being changed. In the case of the subject-matter of EP 0 25 537 652 B1 the ornamental hood is a one-piece, bell-shaped part which is capable of being screw-coupled on an external thread of the sleeve with a view to changing the axial position. The covering rosette consisting of ornamental hood and sleeve is fixed in the connection region of the wall-fitting by an entire axial length of the unit being adjusted as a result of screw-coupling of the ornamental hood on the sleeve, in which case the free edge of the ornamental hood abuts the mounting-wall and the free edge of the sleeve abuts the sanitary fitting.

In those cases where wedging of the entire covering rosette between wall-fitting and mounting-wall is not possible or not reliably possible in this manner, the known covering rosette cannot be reliably fixed in its location in clearance-free manner.

The object of the present invention is to configure a covering rosette of the type mentioned in the introduction in such a way that it can be mounted easily, whereby the position of all the individual parts is always defined, even under unfavourable mounting conditions.

In accordance with the invention this object is achieved in that d) the ornamental hood consists of two detachably assembled parts;

e) the sleeve exhibits an internal thread that is complementary to the external thread on the end of the S-shaped connecting piece on the fitting side. In accordance with the invention the sleeve is accordingly fixed to the S-shaped connecting piece in the mounted position of the wall-fitting. On this S-shaped connecting piece it can be rotated so far away from the wall-fitting with the aid of the interacting threads that the union nut of the wall-fitting becomes accessible. Conversely it can be screw-coupled on the external thread of the S-shaped connecting piece in the direction-of the wall-fitting in such a way that it totally conceals not only the end of the S-shaped connecting piece on the fitting side but also the union nut from the view of the observer. Since with this "connection philosophy" the screw-coupling of the sleeve on the external thread of the S-shaped connecting piece on the fitting side has to be effected with the ornamental hood taken off, the ornamental hood cannot—as is otherwise customary and also described in EP 0 499 856 B1—be of one-piece construction. By virtue of the fact that, according to the invention, it consists of-two detachably assembled parts, after the mounting-work has been fully concluded it can be placed from the side around the S-shaped connecting piece and the sleeve and assembled. This mounting is extraordinarily simple. Each part has its reliable support, since the sleeve is fixed to the S-shaped connecting piece and the ornamental hood is fixed to the sleeve.

It is advantageous if the ornamental hood is capable of being screw-coupled on an external thread of the sleeve. Attachment of the ornamental hood onto the sleeve can then be effected at a distance from the mounting-wall; a gap which is still present to begin with between ornamental hood and mounting-wall is closed by appropriate screw-coupling of the ornamental hood on the sleeve.

Particularly expedient and inexpensive in this connection is that configuration in which the ornamental hood exhibits at least one insertion part consisting of cellular rubber which interacts with the external thread of the sleeve. This cellular-rubber part then serves both as a seal and as a self-cutting thread which constitutes the counterpart to the external thread on the sleeve.

The two parts of the ornamental hood should be capable of being joined to one another in a manner which is visually as inconspicuous as possible. For this purpose it is advisable if each part of the ornamental hood exhibits a guide projection and a guide bore that is complementary to said guide projection. Guide bore and guide projection are so arranged and designed that the two parts abut each other in alignment when their guide projections are introduced into the corresponding guide bores of the other part.

An unintentional detachment of the two parts of the ornamental hood is avoided in that configuration of the invention in which each part of the ornamental hood exhibits a protruding latching shackle and a recess which is constructed for interacting with such a latching shackle.

That configuration in which both parts of the ornamental hood are constructed as identical halves is particularly cost-effective.

Figure 2:
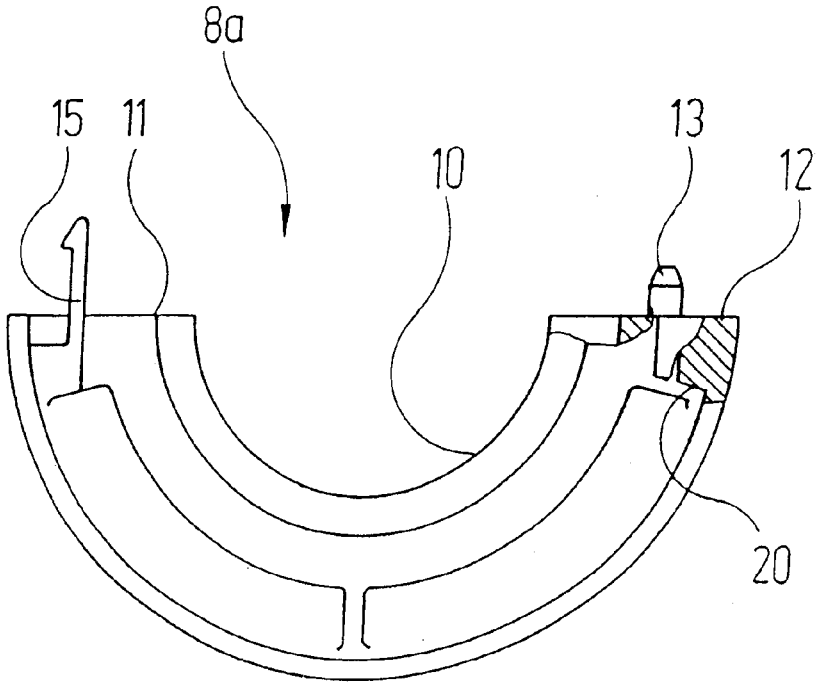
Figure 3:
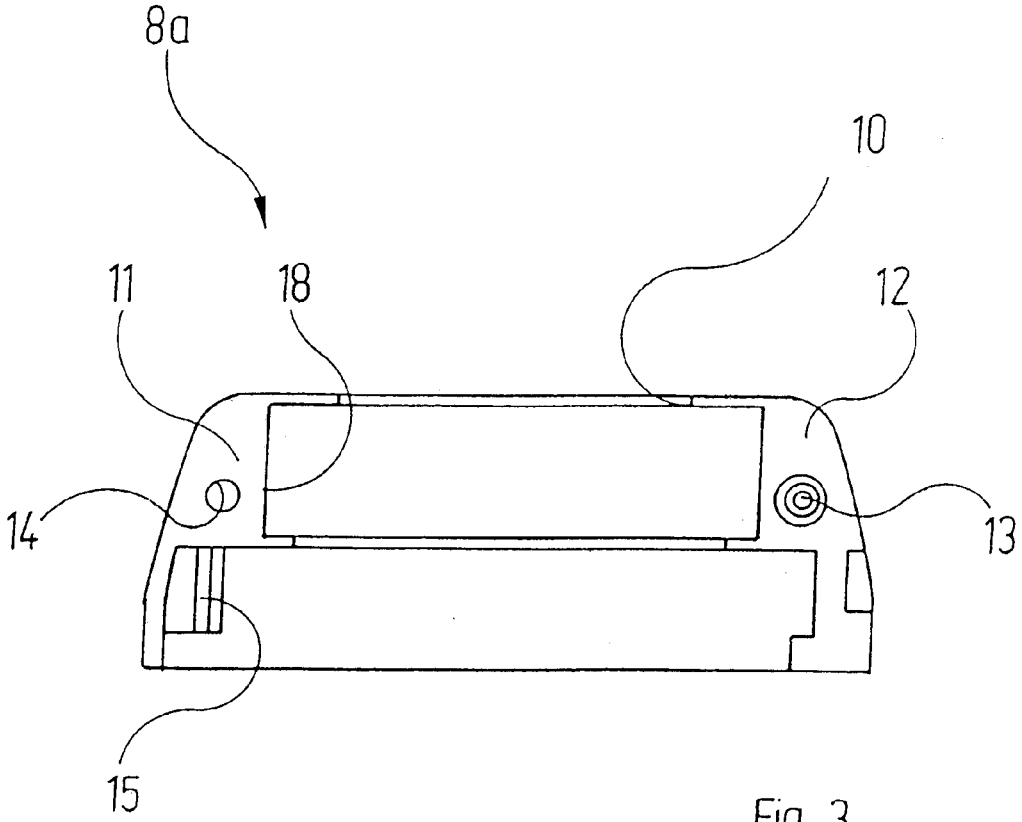
Figure 4:
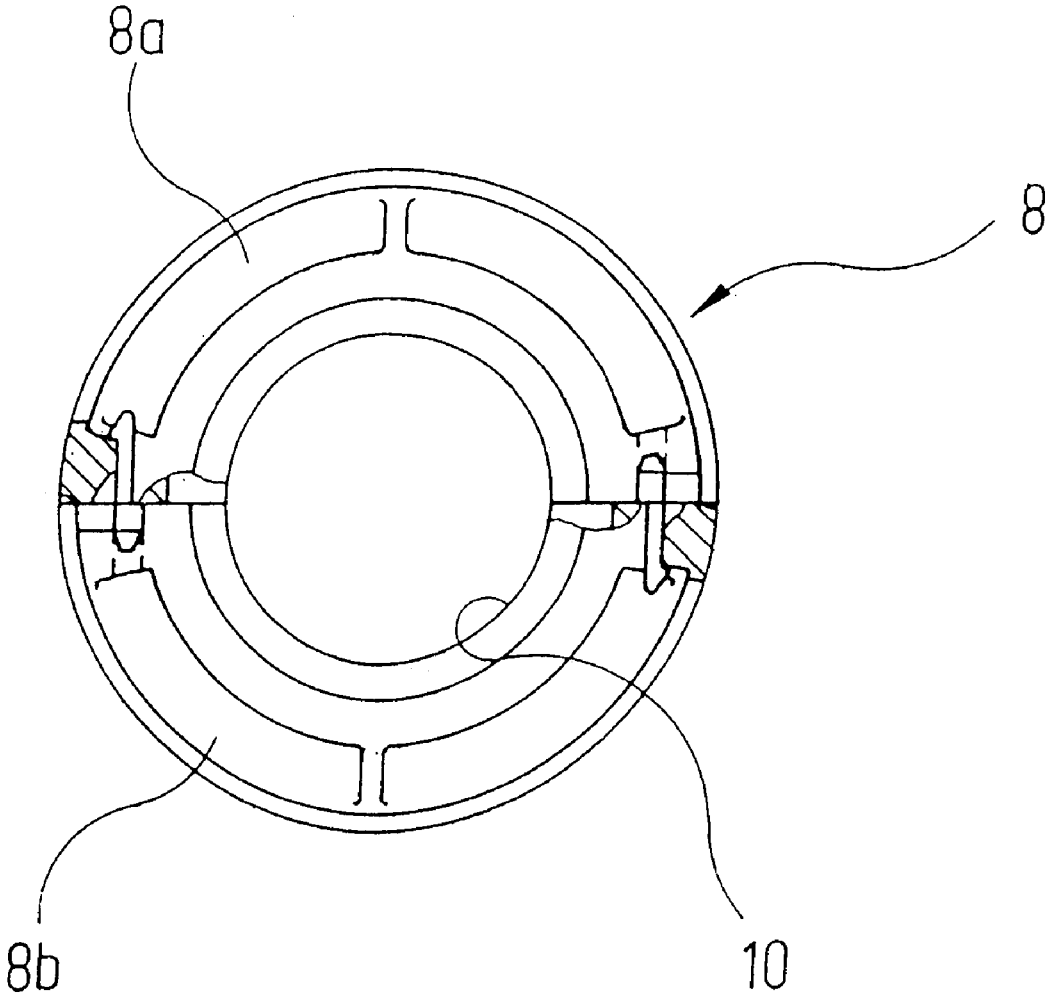

An example of an embodiment of the invention is elucidated in more detail below on the basis of the drawing; illustrated are:

FIG. 1 a section through the connection region of a sanitary wall-fitting;

FIG. 2 the bottom view of an ornamental-hood half such as is part of a covering rosette according to the invention;

FIG. 3 the front view of the ornamental-hood half shown in FIG. 2;

FIG. 4 schematically, the bottom view of a complete ornamental hood which is assembled from two halves.

In FIG. 1 the housing of a sanitary wall-fitting is represented only partially and is provided with the reference symbol 1. With this wall-fitting it is a question of a mixer fitting which is connected at two points on the mounting-wall spaced apart from one another to a cold-water service-pipe and to a hot-water service-pipe. In FIG. 1 only one connection region of the wall-fitting is represented; a second connection region of analogous construction has to be imagined further up in FIG. 1.

In the housing 1 of the wall-fitting there is screwed, in a manner known as such, a connecting nipple 2 which retains a union nut 3. The union nut 3 is screwed onto an external thread 5 at one end of an S-shaped connecting piece 4. The latter exhibits at the other end a second external thread 6 which serves for connection to the water service-pipe, which is not represented. The precise structural design of the S-shaped connecting piece 4 plays no role in the present context. The function of the S-shaped connecting piece 4 and the various structural designs for it are known to a person skilled in the art.

The covering rosette, which is provided overall with the reference symbol 7, comprises two principal components: an ornamental hood 8 assembled from two identical halves 8*a*, 8*b* and also a sleeve 9 which is coaxial with said ornamental hood.

The precise structural design of the ornamental hood 8 can be gathered from FIGS. 2 to 4.

As can be discerned in FIG. 4 in particular, the ornamental hood 8 consists of two identical halves 8*a*, 8*b* which are detachably fastened to one another by means of a latching connection. The form of the covering hood 8 is somewhat bell-shaped with a central passage opening 10, through which the sleeve 9 extends in a manner yet to be described.

One half 8*a* of the ornamental hood 8 is represented in more detail in FIGS. 2 and 3. In the bottom view shown in FIG. 2 the ornamental-hood half 8*a* is represented as a semicircular ring which exhibits radially extending wall regions 11, 12 on its front faces pointing upwards in FIG. 2. Moulded onto the wall region 12 on the right in FIGS. 2 and 3 is a cylindrical guide projection 13, whereas a corresponding guide bore 14 is inserted into the wall region 11 which is on the left in FIG. 3.

In a region located below the guide bore 14 in FIG. 3, which is accordingly located closer to the mounting-wall in the mounted position of the ornamental hood 8, there is moulded onto the ornamental-hood half 8*a* a latching shackle 15 which extends beyond the front face 11. This can be gathered, in particular, from FIG. 2. Complementary to this, a latching ridge 20 (cf. FIG. 2) is formed on the opposite end of the ornamental-hood half 8*a*, below the wall region 12 and the guide projection 13 which is moulded onto it.

Two ornamental-hood halves 8*a*, 8*b* of the type represented in FIGS. 2 and 3 can obviously be assembled to form a complete ornamental hood 8, as represented in FIG. 4, by the guide projection 13 of either ornamental-hood half 8*a* being introduced into the corresponding guide bore 14 of the other ornamental-hood half 8*b* and by the latching shackle 15 of each ornamental-hood half 8*a*, 8*b* being simultaneously locked in position behind the corresponding latching ridge 20 of the respective other ornamental-hood half 8*a*, 8*b*.

The sleeve 9 exhibits a principal region 9*a* pointing to the left in FIG. 1—that is to say, towards the mounting-wall —and a cylindrical neck 9*b*, coaxial with said principal region and pointing to the right in FIG. 1 towards the housing 1 of the fitting, which is reduced in wall thickness. The principal region 9*a* of the sleeve 9 is screwed by an internal thread 16 onto the external thread 5 of the S-shaped connecting piece 4. The cylindrical neck 9*b* of the sleeve surrounds and covers the union nut 3.

The outside diameter of the principal region 9*a* of the sleeve 9 corresponds to the diameter of the passage opening 10 of the ornamental hood 8. An external thread 17 is located on the outer circumferential surface of the sleeve 9 which exhibits this diameter.

Each ornamental-hood half 8*a* exhibits in its upper region a semi-annular receiving space 18 (cf. also FIG. 3) for a semi-annular cellular-rubber part 19 of complementary shape. The external thread 17 of the sleeve 9 is screwed from one side into the two cellular-rubber parts 19 complementing one another to form a complete ring, whereby it intersects its own thread in these cellular-rubber parts 19.

Connection of the wall-fitting to the service-pipe with the aid of the S-shaped connecting piece 4 and also mounting of the covering rosette 8 are effected in the following way:

Firstly the S-shaped connecting piece 4 is fastened in known manner to the service-pipe by its external thread 6 which is on the left in FIG. 1; the rotary position of the S-shaped connecting piece 4 about the axis of the external thread 6 is chosen in such a way as to result overall in the correct spacing between the two connecting nipples 2 of the wall-fitting. Now the sleeve 9 is screwed onto the end of the S-shaped connecting piece 4 on the right in FIG. 1 and is twisted there so far to the left in FIG. 1 that the cylindrical neck 9*b* of the sleeve 9 releases the right-hand region of the external thread 5 of the S-shaped connecting piece 4. Now the housing 1 of the fitting can be screwed on the end of the S-shaped connecting piece 4 remote from the wall with the aid of the union nut 3, the key surfaces of which are exposed in this relative position of the sleeve 9. After this, the sleeve 9 is twisted to the right on the external thread 5 of the S-shaped connecting piece 4 until the cylindrical neck 9*b* of the sleeve 9 totally surrounds the union nut 3 in the manner represented in FIG. 1 and its narrow annular front face abuts the housing 1 of the fitting.

Finally, the two ornamental-hood halves 8*a*, 8*b* are placed from the side around the principal region 9*a* of the sleeve 9 and are latched together in the manner shown in FIG. 4. By means of a conclusive twisting of the complete ornamental hood B which has been formed in this way on the external thread 17 of the principal region 9*a* of the sleeve 9 the edge of the ornamental hood 8 which is on the left in FIG. 1 can be brought into exact abutment against the outer surface of the mounting-wall.

Dismantling of the wall-fitting and of the covering rosette 8 are effected in inverse manner.

What is claimed is:

1. Covering rosette for the connection region of a sanitary wall-fitting with a) an ornamental hood which is capable of being attached to the mounting-wall and which exhibits a central passage opening;

b) a sleeve which is capable of being adjusted in the axial direction in relation to the ornamental hood and which passes through the passage opening of the ornamental hood; whereby c) the interior spaces of ornamental hood and sleeve are configured to receive an S-shaped connecting piece which serves for connection between a water service-pipe installed in the mounting-wall and the wall-fitting and also serves to receive a union nut which serves for fastening the wall-fitting to the S-shaped connecting piece, characterised in that d) the ornamental hood (8) consists of two detachably assembled parts (8*a*, 8*b*);

e) the sleeve (9) exhibits an internal thread (16) which is complementary to the external thread (5) on the end of the S-shaped connecting piece (4) on the fitting side.

2. Covering rosette according to claim 1, characterised in that the ornamental hood,(8) is capable of being screw-coupled on an external thread (17) of the sleeve (9).

3. Covering rosette according to claim 2, characterised in that the ornamental hood (8) exhibits at least one insertion part (19) made of cellular rubber which interacts with the external thread (17) of the sleeve (9).

4. Covering rosette according to claim 1, characterised in that each part (8*a*, 8*b*) of the ornamental hood (8) exhibits a guide projection (13) and a guide bore (14) which is complementary to said guide projection.

5. Covering rosette according to claim 1, characterised in that each part (8*a*, 8*b*) of the ornamental hood (8) exhibits a protruding latching shackle (15) and a latching recess (20) which is constructed for interacting with such a latching shackle (15).

6. Covering rosette according to claim 1, characterised in that both parts (8*a*, 8*b*) of the ornamental hood (8) are constructed as identical halves.

* * * * *